US008069625B2

(12) United States Patent
Harkins et al.

(10) Patent No.: US 8,069,625 B2
(45) Date of Patent: Dec. 6, 2011

(54) FIRE-RESISTANT FRAME ASSEMBLIES FOR BUILDING

(75) Inventors: Jim Harkins, Edmonds, WA (US); John Gaydos, Kent, WA (US)

(73) Assignee: Washington Hardwoods Co., LLC, Seattle, WA (US)

( * ) Notice: Subject to any disclaimer, the term of this patent is extended or adjusted under 35 U.S.C. 154(b) by 0 days.

(21) Appl. No.: 12/357,255

(22) Filed: Jan. 21, 2009

(65) Prior Publication Data

US 2009/0133344 A1 May 28, 2009

Related U.S. Application Data

(60) Division of application No. 11/381,464, filed on May 3, 2006, now Pat. No. 7,487,591, which is a continuation of application No. 10/374,927, filed on Feb. 25, 2003, now Pat. No. 7,059,092.

(60) Provisional application No. 60/360,191, filed on Feb. 26, 2002.

(51) Int. Cl.
*E04C 2/00* (2006.01)

(52) U.S. Cl. ..... 52/232; 52/210; 52/784.11

(58) Field of Classification Search ..... 52/232, 52/210, 784.11

See application file for complete search history.

(56) References Cited

U.S. PATENT DOCUMENTS

| | | | | |
|---|---|---|---|---|
| 1,778,443 | A | | 10/1930 | Zellmer |
| 3,566,541 | A | * | 3/1971 | Coulter ..... 49/475.1 |
| 3,783,567 | A | | 1/1974 | Ollis |
| 4,307,543 | A | | 12/1981 | Schulthess |
| 4,850,173 | A | | 7/1989 | Beyer et al. |
| 4,930,276 | A | | 6/1990 | Bawa et al. |
| 4,993,203 | A | | 2/1991 | Tanaka et al. |
| 5,401,793 | A | | 3/1995 | Kobayashi et al. |
| 5,417,024 | A | | 5/1995 | San Paolo |
| 5,452,551 | A | | 9/1995 | Charland et al. |

(Continued)

FOREIGN PATENT DOCUMENTS

JP 05133170 A 5/1993

(Continued)

OTHER PUBLICATIONS

VT Industries, Inc., Architectural Wood Doors, http://www.vtindustries.com/doors/OPGFireDoorsPositivePressureFireDoorsMain.html, visited Feb. 12, 2002.

(Continued)

*Primary Examiner* — Jeannette E Chapman
*Assistant Examiner* — Daniel Kenny
(74) *Attorney, Agent, or Firm* — Stoel Rives LLP

(57) ABSTRACT

Fire resistant door, glazing, and mullion frames include intumescent material at least partially embedded in the frame adjacent the door or glazing. Trim materials are positioned over the intumescent material to prevent tampering with and damage to the intumescent material while improving the aesthetic appearance of the frame. The jamb trim has a thickness that allows heat to be transmitted to the intumescent material in the event of a fire so that the intumescent material will expand and fill a clearance space between the frame and the door or glazing. The expanded intumescent material retards the passage of heat and, by sealing the clearance space, inhibits the transmission of smoke, flames and gases from one side of the door or glazing to the other. After expanding, the intumescent material will char and solidify, which may provide an added benefit of structural support for the door or glazing.

34 Claims, 6 Drawing Sheets

U.S. PATENT DOCUMENTS

| | | | | |
|---|---|---|---|---|
| 5,687,532 | A | 11/1997 | Torrey | |
| 5,701,708 | A | 12/1997 | Taraba et al. | |
| 5,740,635 | A | 4/1998 | Gil et al. | |
| 5,816,017 | A | 10/1998 | Hunt et al. | |
| 5,916,077 | A | 6/1999 | Tang | |
| 6,115,976 | A | 9/2000 | Gomez | |
| 6,119,411 | A | 9/2000 | Mateu Gil et al. | |
| 6,141,923 | A | 11/2000 | Habicht et al. | |
| 6,170,210 | B1 | 1/2001 | Marts | |
| 6,405,502 | B1 | 6/2002 | Cornwall | |
| 6,421,968 | B2 | 7/2002 | Degelsegger | |
| 6,434,899 | B1 | 8/2002 | Fortin et al. | |
| 6,550,196 | B2 | 4/2003 | Braybrook | |
| 6,606,831 | B2 | 8/2003 | Degelsegger | |
| 6,668,499 | B2 | 12/2003 | Degelsegger | |
| 6,745,526 | B1 | 6/2004 | Autovino | |
| 7,059,092 | B2 | 6/2006 | Harkins et al. | |
| 7,487,591 | B2 | 2/2009 | Harkins et al. | |
| 2001/0018814 | A1 | 9/2001 | Degelsegger | |
| 2003/0024184 | A1 | 2/2003 | Orr, Jr. et al. | |
| 2003/0037507 | A1 * | 2/2003 | Weza | 52/730.7 |
| 2004/0016191 | A1 | 1/2004 | Whitty | |

FOREIGN PATENT DOCUMENTS

| | | | |
|---|---|---|---|
| JP | 05302479 | A | 11/1993 |

OTHER PUBLICATIONS

VT Industries, Inc., Positive Pressure Fire Door Installation Instructions, http://www.vtindustries.com/doors/OPGFireDoorsPositivePressureFireDoorInstallationInstructionsMain.html, visited Feb. 12, 2002.

VT Industries, Inc., Useful Jobsite Information for VT Architectural Doors (date unknown).

VT Industries, Inc., When You're Choosing Wood Fire Doors . . . Think Positive (date unknown).

Summit Door Incorporated, FlameTech® Series Fire Rated Wood & Glass Systems, Jun. 2000 and Feb. 2001.

PEMKO, HSS2000 Dadoed in Frame Edge Sealing System—Wood Door × Softwood Frame with Applied Stop, Drawing No. 09-30, Revision Date Nov. 8, 1999.

PEMKO, HSS2000 Concealed in Door Edge Sealing System—Wood Door × Softwood Frame with Applied Stop, Drawing No. 09-01, Revision Date Nov. 8, 1999.

PEMKO, HSS1000 Kerfed in Frame Edge Sealing System—Wood Door × Softwood Frame with Applied Stop, Drawing No. 08-19, Revision Date Nov. 3, 1999.

PEMKO, HSS1000 Concealed in Door Edge Sealing System—Wood Door × Hollow Metal Frame, Drawing No. 06-10, Revision Date Nov. 3, 1999.

PEMKO, HSS1000 Kerfed in Door Edge Sealing System—Wood Door × Hollow Metal Frame, Drawing No. 06-01, Revision Date Nov. 3, 1999.

PEMKO, HSS2000 Edge Sealing System—Wood Door Meeting Stile, Drawing No. 04-07, Revision Date Nov. 3, 1999.

Wood for Good Limited, Building with Wood—Fire Resisting Doorsets FAQ's, http://www.woodforgood.com/building/fdoors/frame.htm, visited Feb. 12, 2002.

Architectural Record, Positive Pressure Ripples Through the Door Industry, May 2001.

National Guard Products, Inc., Upgrade Solutions from NGP Fire Doors to Positive Pressure and 'S' Label (date unknown).

BASF AG, Intumescent Materials, 1999.

BASF AG, Palusol®—Fireboards, Feb. 18, 2002.

3M Company, 3M™ Graphite Intumescent Seal Complies With New Testing Criteria, Improves Life Safety, 2000.

3M Company, Graphite Intumescent Seal, 1999.

3M Company, Fire Barrier Moldable Putty+ Product Data, 1999.

PEMKO, HSS2000 Hot Smoke Seal, http://www.pemko.com/products/hss2000.html, visited Feb. 18, 2002.

Enviromental Seals Ltd., Envirograf®, http://www.envirograf.com/products/product038.html, visited Feb. 12, 2002.

Pilkington plc, Pilkingston Pyrostop™ Fire-Resistant Glass, 2001.

International Search Report for PCT/US03/05741; mailed Sep. 17, 2003, 5 pages.

Intertek Testing Services NA Inc., Inspection Manual and Manufacturing Specifications for Woodtech Trading to Manufacture Georgia Pacific 20 thru 90 Minute Fire Doors and Frames, 1999, 3 pages.

Woodtech Doors, 60M & 90M Positive Pressure Rated T-stop Frame, http://woodtechdoor.com/imagedisplay.php?file=frames_large/T-stop_60PP.gif&nodb=1, visited May 14, 2009, 1 page.

Georgia-Pacific, Downloadable Material Safety Data Sheets for FireDefender® FS (previously named Firestop) and FireDefender® FS II (previously names Firestop) et al, http://www.gp.com/build/pageviewer.aspx?repository=bp&elementid=4510, visited Apr. 2, 2010, 1 page.

Georgia-Pacific, Material Safety Data Sheet for FireDefender® FS, Sep. 1, 2009, 6 pages.

Georgia-Pacific, Material Safety Data Sheet for FireDefender® FS II, Sep. 10, 2009, 6 pages.

Georgia-Pacific Gypsum, FireDefender® protection components, 2008, 4 pages.

Georgia-Pacific, FireDefender FS physical properties, http://www.gp.com/build/product.aspx?pid=5825, visited May 7, 2010, 1 page.

* cited by examiner

FIRE-RESISTANT FRAME ASSEMBLIES FOR BUILDING

RELATED APPLICATIONS

This application is a division of and claims the benefit under 35 U.S.C. §121 from U.S. patent application Ser. No. 11/381,464, filed May 3, 2006, which is a continuation of and claims the benefit under 35 U.S.C. §120 from U.S. patent application Ser. No. 10/374,927, filed Feb. 25, 2003, now U.S. Pat. No. 7,059,092, which claims the benefit under 35 U.S.C. §119(e) of U.S. Provisional Patent Application No. 60/360,191, filed Feb. 26, 2002. Each of the foregoing applications is incorporated herein by reference in its entirety.

BACKGROUND

This disclosure relates to fire resistant door frames, relite frames, sidelite frames, transom frames, borrowed light frames, and mullions, and to such structures that withstand positive-pressure fire testing necessary for enhanced fire code ratings.

In the construction of buildings and, more particularly, the construction of institutional and commercial buildings, it is common and sometimes necessary to include interior room and space walls with door openings and interior windows called "lights" or glazing. The openings for doors and glazing are usually first roughly framed in with wall studs. Door frames and glazing frame assemblies are then attached to the studs and the assemblies are finished with wallboard, doors, and glazing.

In many commercial building interiors, wooden interior doors and door frames are preferred over metal doors and frames because exposed wood surfaces enhance the aesthetics of the interior spaces. Wood framing and mullions (including light-to-light mullions and door-to-light mullions) are also commonly used for interior glass panels including relites, sidelites (a.k.a. sidelights), borrowed lights, transom lights, vision lights, and any other light-transmitting panel installed in a wall or door (collectively, "glazed openings"). To reduce costs, wood assemblies for doors and door frames are often constructed with a shaved wood veneer adhered to the exterior of a manufactured fiber core material, such as medium density fiberboard ("MDF"). High-quality wood assemblies use similar core materials, but with a solid wood facing or trim that is precision-cut, not shaved. Typically, solid wood facing is slightly thicker than veneer, making it more durable, stronger, and longer lasting than veneer assemblies. However, solid wood surfaces typically provide more fuel for a fire than veneer, which reduces fire resistance of the assembly.

Modern fire codes and architectural practices require doors and door frames to be constructed in accordance with designs that have undergone fire testing performed by accredited testing facilities in accordance with established standard test procedures. One widely recognized test procedure is a 45-minute positive-pressure test performed by Intertek Testing Services (ITS/Warnock Hersey) of Boxborough, Mass., USA for rating in accordance with the following standards: NFPA 252, CAN4-S104, UBC 7-2 1997, ISO 3008, and BS476 Part 22. Positive-pressure testing requires doors, door frames, glazed openings, and their frames and mullions to be tested as an assembly. The interior side of the assembly (facing toward the door when opened) is subjected to a furnace flame with positive pressure applied to the burn zone at a predetermined height from the bottom of the door. The tests permit only a limited amount of smoke to escape around the door and glazed openings.

In an attempt to meet positive-pressure testing requirements, known prior-art designs have included intumescent materials in the doors and door frames. When exposed to heat generated in a fire, intumescent materials quickly foam and expand, then char and solidify to provide a strong, fire-resistant seal that also inhibits the penetration of smoke around doors. Intumescent materials typically activate at temperatures in excess of 400° F., but may activate at higher or lower temperatures depending on the type of intumescent material used.

One known door frame design calls for workers at the construction site to apply adhesive-backed strips of graphite intumescent material against a door jamb surface called the rabbet (where the frame is stepped to receive the door). Such designs are subject to failure due to improper installation, tampering, and damage to the exposed intumescent material. Moreover, the only frames of this type known to comply with 45-minute positive-pressure testing are hollow metal frames.

Another known use of intumescent material is a door sold by VT Industries of Holstein, Iowa, USA that includes an intumescent strip embedded between a core of the door and a wood veneer along an edge of the door. However, to comply with 45-minute positive pressure testing, the VT Industries doors must be installed in a door frame that has been tested as an assembly with the VT Industries door. The only frames known to comply with 45-minute positive-pressure testing when used with the VT Industries door are metal frames to which intumescent material has been applied against the rabbet surface, as described above. Thus a need exists for a door frame assembly that complies with 45-minute positive-pressure test standards, which is more aesthetically pleasing and which does not expose the intumescent material to tampering and damage.

The present inventors have also recognized a need for an improved fire resistant sidelight frame. Summit Door, Inc., St. Paul, Minn., USA sells frames for sidelight openings that have successfully undergone 45-minute positive-pressure tests. This sidelite frame design uses intumescent strips inlaid against its top (header), bottom (sill), and sides (jambs) and between the glass panel and wooden stops that are fastened to the frame on both sides of the glass panel. This design requires the glass to be installed in the frame using metal glazing clips before the wooden stops are installed. The metal glazing clips are apparently necessary to provide support for the glass panel in the event of a fire. The metal glazing clips provide structural support for the glass panel, but add to the material cost as well as the time and cost involved in installing it. Thus there remains a need for aesthetically pleasing wood frames and mullions for glazed openings that will pass a 45-minute positive-pressure test without the need for expensive metal glazing clips.

BRIEF DESCRIPTION OF THE DRAWINGS

Features, aspects, and advantages of the present invention are set forth in the following description, appended claims, and accompanying drawings wherein:

DETAILED DESCRIPTION OF PREFERRED EMBODIMENTS

Figure 1:
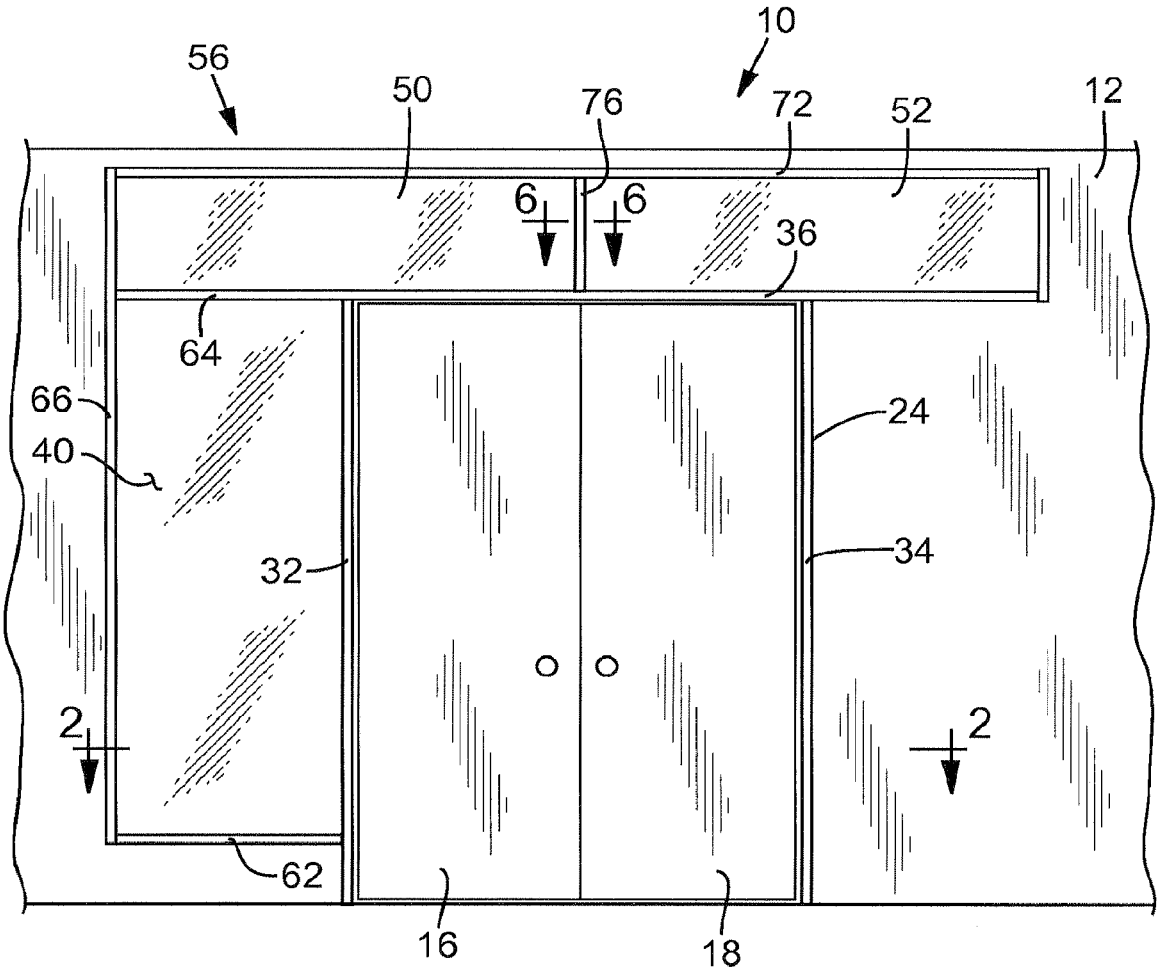
FIG. 1 is a front elevation view of an example doorway assembly configuration including framing assemblies in accordance with a preferred embodiment.

FIG. 1 is a front elevation view of a doorway and light assembly 10 installed in a wall 12 in an example configuration including framing assemblies in accordance with a preferred embodiment. With reference to FIG. 1, doorway and light assembly 10 includes a pair of doors 16 and 18 installed in a door frame 24 that includes a left side jamb 32, a right side jamb 34, and a head jamb 36. Doorway and light assembly 10 also includes a sidelite 40 and a pair of transom lights 50 and 52 (collectively "glazed openings 56"). Glazed openings 56 are framed by glazing frame members including, for example, a sidelite sill 62, a sidelite jamb 66, a transom header 72, and a transom mullion 76. Persons skilled in the art will understand that glazed openings 56 can be arranged in a variety of configurations and sizes, and include other types of glazed openings, such as, for example, relites, doorlites, and any other glass panel installed in a wall or door. Each of these glazed openings includes glazing frame assemblies that can be constructed in accordance with the present invention, embodiments of which are described below in detail.

Figure 2:
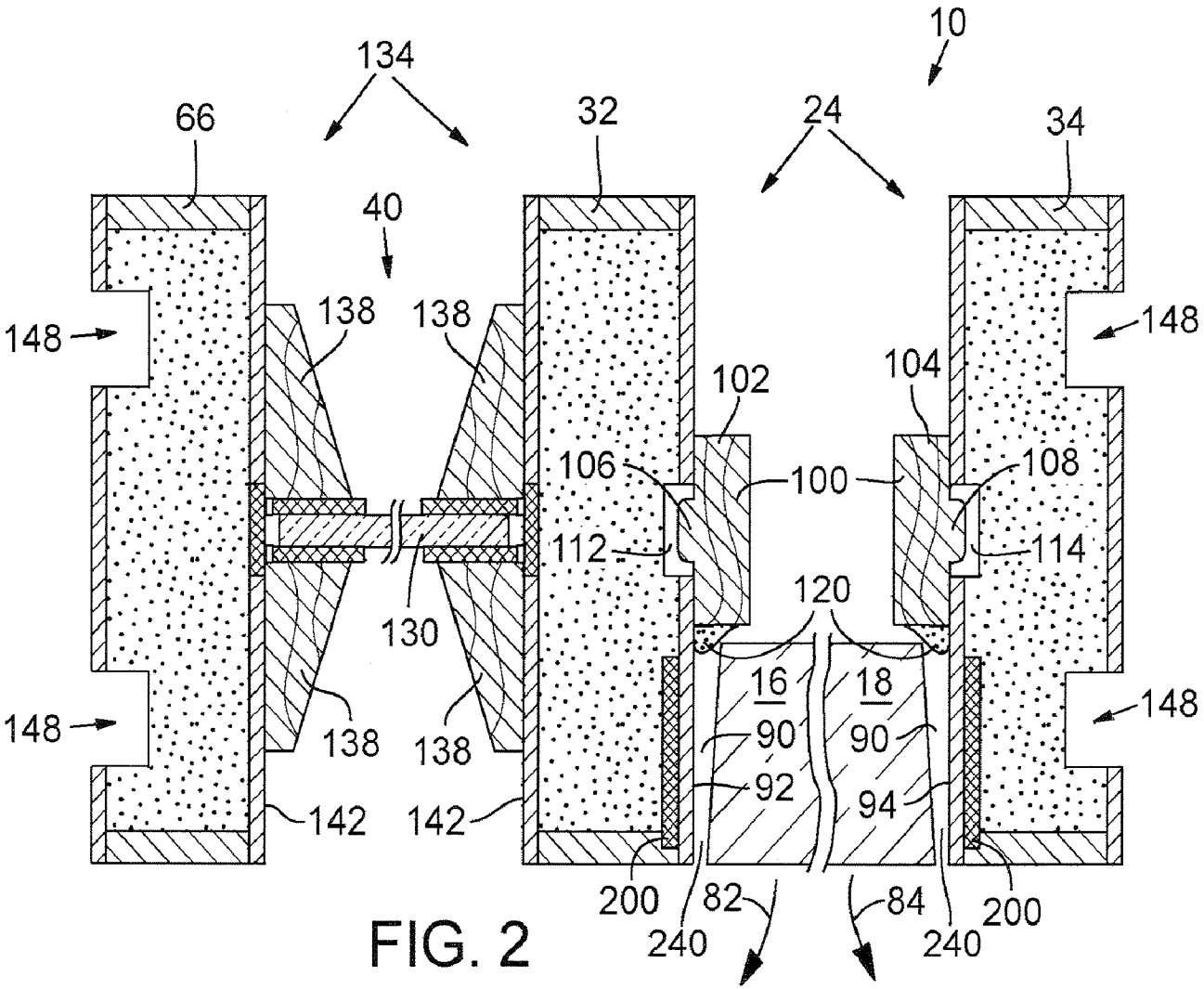
FIG. 2 is a enlarged broken sectional view of the doorway and light assembly of FIG. 1 taken along line 2-2 of FIG. 1, including a sidelite frame and a door frame.

FIG. 2 is a enlarged broken sectional view of doorway and light assembly 10 taken along line 2-2 of FIG. 1. With reference to FIG. 2, doors 16 and 18 are supported on hinges (not shown), which are attached to respective left and right side door jambs 32 and 34 so that doors 16 and 18 open inwardly in the direction shown by arrows 82 and 84. When closed, doors 16 and 18 are received in a rabbet 90 that extends along respective left and right door-side surfaces 92 and 94 of door jambs 32 and 34, as well as along a downwardly facing door-side surface (not shown) of head jamb 36. Rabbet 90 is bounded by a stop 100 against which doors 16 and 18 abut when closed. Stop 100 preferably includes left and right applied stops 102 and 104, which are typically installed at the construction site by nailing or otherwise fastening to respective left and right side door jambs 32 and 34. To facilitate installation, left and right applied stops 102 and 104 are preferably T-stops that include tongues 106 and 108 sized to fit in respective stop channels 112 and 114 formed in respective left and right door-side surfaces 92 and 94. In alternative embodiments (not shown), the stops are formed integrally with the side jamb and head jamb members 32, 34, and 36 or omitted altogether.

A flexible smoke seal strip 120 is applied to and extends along stop 100. Smoke seal strip 120 compresses when doors 16 and 18 are closed against it, to inhibit smoke from passing between doors 16 and 18 and door frame 24 in the early stages of a fire. A preferred smoke seal material is an edge sealing system sold under the trademark S88™ by Pemko Manufacturing Company of Ventura, Calif., USA. Persons skilled in the art will understand that many other smoke seal products exist and would be suitable for use with embodiments of the invention.

Continuing with reference to FIG. 2, sidelite 40 includes a sidelite glass 130 supported by sidelite jamb 66 and left side door jamb 32. Left side jamb 32 in this example is also considered a mullion because it divides a door and a sidelite, rather than being mounted to a wall. Grouped together, sidelite jamb 66, left side jamb/mullion 32, sidelite sill 62, and a sidelite head 64 (FIG. 1) are considered a glazing frame 134. Sidelite glass 130 is secured to glazing frame 134 by glazing stops 138 that are attached to jamb side surfaces 142 of glazing frame 134 during installation of sidelite glass 130, to thereby grasp or snugly pinch sidelite glass 130 between adjacent pairs of glazing stops 138.

Sidelite jamb 66 and right side door jamb 34 include drywall grooves 148 sized to receive edges of drywall panels. For clarity, drywall panels and wall studs are omitted in FIG. 2, but shown in FIGS. 3 and 4. Skilled persons will understand that many other methods and means can be used for attaching jambs 66 and 34 to walls, studs, and drywall panels for a quality appearance. For example, in one alternative embodiment (not shown) drywall grooves 148 are moved to the edges of jambs 66 and 34 to create a T-shape that fits flush with drywall panels. In another alternative embodiment (not shown), drywall grooves 148 are omitted entirely for a flush mounted jamb called a "flatjamb." In each alternative embodiment, applied trim can be used to cover the seams between the jamb and the drywall panels.

Figure 3:
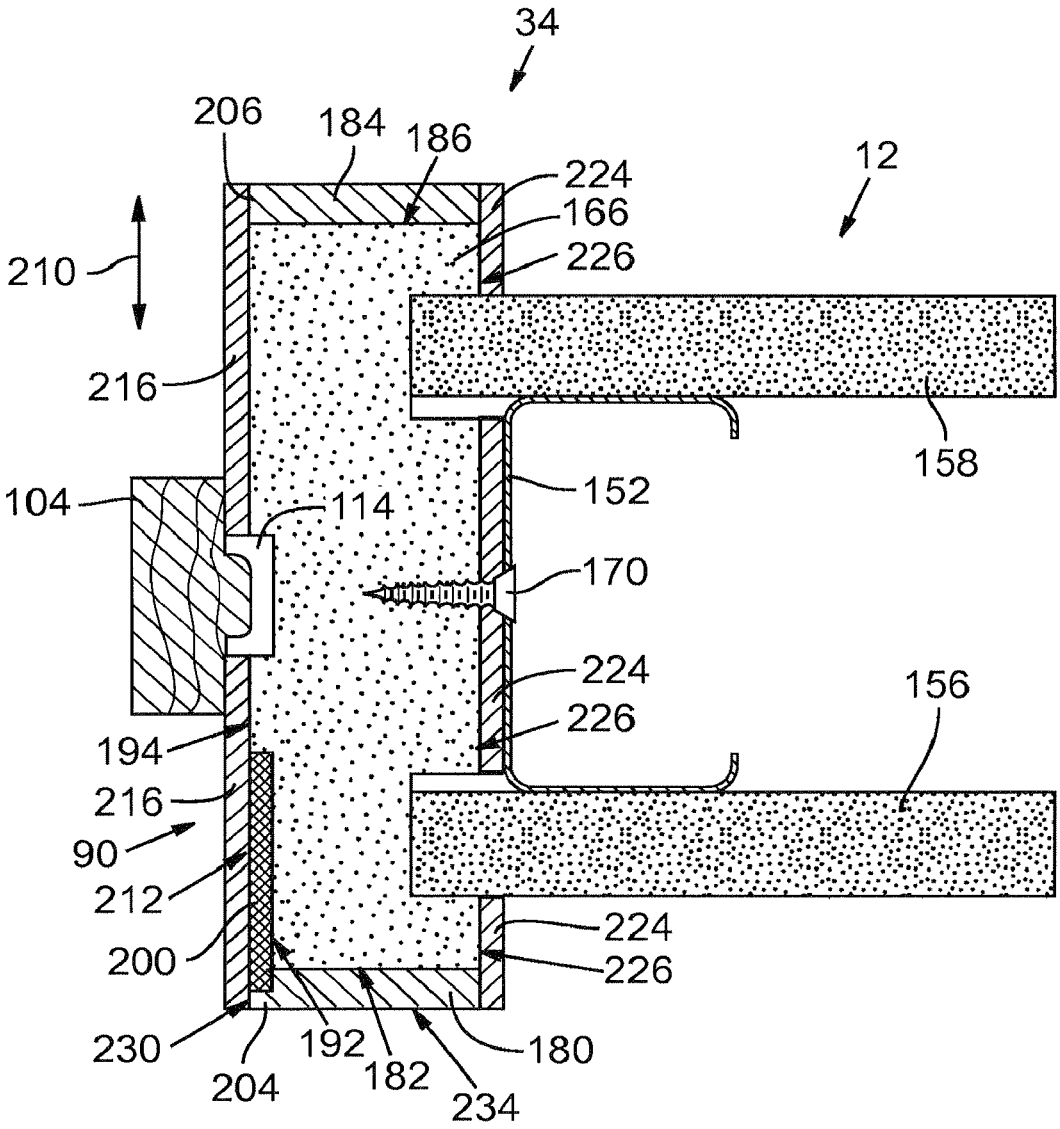
FIG. 3 is an enlarged cross section view showing detail of a right-side door jamb portion of the door frame of FIG. 2.

FIG. 3 is an enlarged cross-sectional view showing detail of right side door jamb 34 and wall 12. With reference to FIG. 3, wall 12 includes a metal C-shaped wall stud 152 that extends vertically to support a pair of drywall panels 156 and 158. Door jamb 34 includes a fire resistant core 166 of material such as a fire resistant medium density fiberboard ("MFMDF") having a "Class 1" Underwriters Laboratory rating. In a preferred embodiment, core 166 is made of a solid piece of MFMDF material having a grain structure aligned with the long dimension of jamb 34 so that the fibers extend generally perpendicular to the section plane of FIG. 3. Orienting the fibers of core 166 in this direction increases the holding power of screws 170 that are used to attach jamb 34 to wall stud 152 and screws used to attach a hinge (not shown) to jamb 34.

The term "core" as used herein is not limited to solid cores, however, and is used herein to denote any structural member over which other materials are applied, regardless of whether solid, hollow, or having other materials mixed throughout, inserted within, or surrounded by core 166. Persons skilled in the art will also understand that materials other than MFMDF may also be suitable for use in core 166. The primary design criteria for core 166 are structural support, dimensional stability, fire resistance, holding power for screws and other fasteners, low cost, and ability to be cut into various shapes and sizes.

A process of making jamb 34 includes applying an inside face trim 180 against an inside face surface 182 of core 166. An outside face trim 184 is similarly applied to an outside face surface 186 of core 166. Inside and outside face trim 180 and 184 are preferably made of solid cut hardwood panels that are glued or otherwise adhered to respective inside and outside face surfaces 182 and 186. However, skilled persons will understand that other materials such as, for example, soft woods and veneers may also be used, as well as non-wood materials such as metal or plastic. Attachment methods other than gluing may also be used to attach face trim 180 and 184 to core 166. Once inside and outside face trim 180 and 184 have been securely adhered to core 166, a dado 192 is then cut or otherwise formed in a jamb side surface 194 of core 166 proximal of rabbet 90. Dado 192 is formed longitudinally in core 166 so that it runs the entire length of jamb 34 and rabbet 90. A strip of intumescent material 200 is then positioned in dado 192 and preferably glued or adhered to snugly fit and fill dado 192. Dado 192 and intumescent material 200 may be made between approximately 0.625 inch (⅝") and 1.750 inches wide and approximately 0.0625 inch (1/16") and 0.1875 inch (3/16") deep/thick, and are preferably approximately 1.5000 inch wide and 0.125 inch (⅛") deep/thick, but may be of other thicknesses and widths, as necessary to fit the application and the door size. To simplify assembly and manufacture, intumescent material 200 preferably includes a preapplied adhesive that is protected by a removable backing paper, which is removed before application of intumescent material 200 within dado 192. According to one embodiment, the intumescent material 200 is raw intumescent material, not plastic wrapped or otherwise encapsulated by a plastic sleeve.

After intumescent material 200 has been fitted in dado 192, the partly assembled jamb undergoes a sanding operation. Sanding is performed by cross sanding against jamb side surface 194 and ends 204 and 206 of respective inside and outside face trim 180 and 184 in the direction shown by arrows 210. In a preferred embodiment, a 24-grit sandpaper is used to cross-sand at a 45-degree angle to and across the longitudinal axis of jamb 34. The sanding operation ensures a flush surface at the junction between jamb side surface 194 of core 166, an outer surface 212 of intumescent material 200, and ends 204 and 206 of face trim 180 and 184. A flush and planar surface facilitates adhesion of a jamb trim layer 216, which is applied after the sanding operation. As with face trim 180 and 184, jamb trim 216 is preferably made of cut hardwood and adhered or glued to core 166, intumescent material 200, and face trim 180 and 184, but may also be made of other materials and attached in other ways within the scope of the present invention. The sanding operation described above should cause little or no abrasion of outer surface 212 of intumescent material 200. Abrasion of intumescent material 200 is undesirable because of a coating on outer surface 212 of intumescent material 200 that inhibits absorption of water and other elements that may degrade intumescent material 200 over time. Consequently, it is desirable for dado 192 to be cut slightly deeper than the thickness of intumescent material 200 so that the sanding operation will primarily affect the other components of jamb 34.

A preferred intumescent material 200 is sold by BASF Aktiengesellschaft of Ludwigshafen, Germany under the trademark PALUSOL-104®. PALUSOL-104 includes a protective coating of the type described above. Intumescent materials other than PALUSOL-104, whether coated or uncoated, may also be suitable for use in embodiments of the invention, for example, Graphite Intumescent Seal (GIS) sold by 3M Company of St. Paul, Minn., USA and HSS2000 Hot Smoke Seal sold by Pemko Manufacturing Company of Ventura, Calif., USA. Preferably, intumescent material 200 should be of the "hard puff" variety to ensure that door frame 24 is quickly sealed in the event of a fire. If an intumescent material that does not include a protective coating is used, it may be desirable to abrade outer surface 212 to encourage adhesion and close contact between jamb trim 216 and outer surface 212 of intumescent material 200.

To complete construction of jamb 34, a backing trim 224 is applied to back surfaces 226 of core 166. Stop channel 114 may also be formed centrally and longitudinally along the door side of jamb 34. As described above, applied stop 104 is preferably installed at the construction site and typically by nailing applied stop 104 to core 166. After installation of applied stop 104, smoke seal strips 120 may be installed adjacent stop 104, as described above with reference to FIG. 2.

Figure 4:
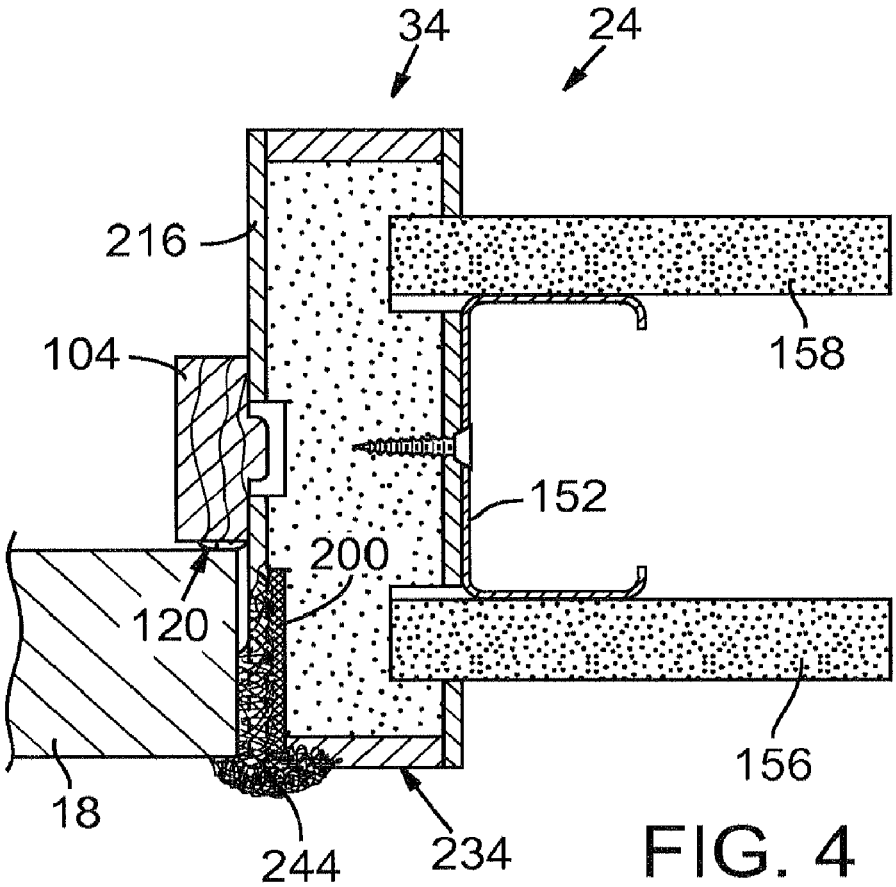
FIG. 4 is a cross section view corresponding to FIG. 3, showing how an intumescent material of the right-side door jamb reacts to a fire to prevent the spread of smoke, flames, and heat between the door and the door frame.

FIG. 4 shows how intumescent material 200 reacts to a fire burning inside of doorframe 24. At an activation temperature, intumescent material 200 begins to build pressure within dado 192. With sufficient pressure, intumescent material 200 expands and bursts through jamb trim 216 along rabbet 90 and through a seam 230 (FIG. 3) between jamb trim 216 and inside face trim 180. To facilitate acceptable timing, placement, and direction of expansion of intumescent material 200, the thicknesses of face trim 180 and jamb trim 216 are carefully selected, as is the location of dado 192 in relation to an inside face surface 234 of inside face trim 180.

More particularly, jamb trim 216 has thickness that is preferably in range of approximately 0.03125 inch (1/32") to 0.09375 inch (3/32"), and more preferably approximately 0.125 inch (⅛"). The thickness of jamb trim 216 is selected so that jamb trim 216 will bulge or fracture when intumescent material 200 expands, thereby allowing intumescent material 200 to fill and seal a clearance gap 240 (FIG. 2) when intumescent material 200 expands. The location and direction of expansion of intumescent material 200 prevent smoke, flames, and heat from passing between door 18 and jamb 34. Additionally, expansion of intumescent material 200 forms a protective insulating plug 244 that further fills and protects the junction between door 18 and door frame 24.

As noted above, dado 192 is preferably positioned in proximity to face surface 234 to increase heat transmission through inside face trim 180 and heat absorption by intumescent material 200. Preferably, dado 192 extends to within between approximately 0.0625 inch (1/16") and 0.1875 inch (3/16") of face surface 234 of inside face trim 180. It is also desirable that dado 192 extend into face trim 180, rather than being cut entirely into core 166. Extending dado 192 into inside face trim 180 facilitates timing and direction of expansion of intumescent material 200 because inside face trim 180 is consumed during early stages of a fire, whereas the fire-resistant core 166 would be likely to insulate and inhibit expansion of intumescent material 200 in a direction perpendicular to face 234. To remain structurally sound during the manufacturing process, inside face trim 180 is preferably selected to have a thickness in the range of 0.125 inch (⅛") and 0.250 inch (¼"). Thinner face trim 180 can shatter during manufacturing when dado 192 is being cut, whereas thicker face trim 180 is more expensive and provides more fuel to burn during a fire. Furthermore, thicker face trim impedes the ability to engage a screw in core 166, thereby reducing the holding power of screws in face 234 of jamb 34 in the event of a fire that consumes inside face trim 180. A similar issue with respect to the holding power of screws arises in the context of a hinge plate (not shown) attached to jamb 34 at rabbet 90. When attaching a hinge plate, screws should be selected with a length that will penetrate fully through intumescent material 200 and into core 166 so that the screws will hold in the event of a fire, even when jamb trim 216 is consumed and intumescent material 200 expands. Accordingly, it is desirable to minimize the thickness of jamb trim 216 and intumescent material 200 as much as possible without affecting the sealing function performed by intumescent material 200 during a fire.

Figure 5:
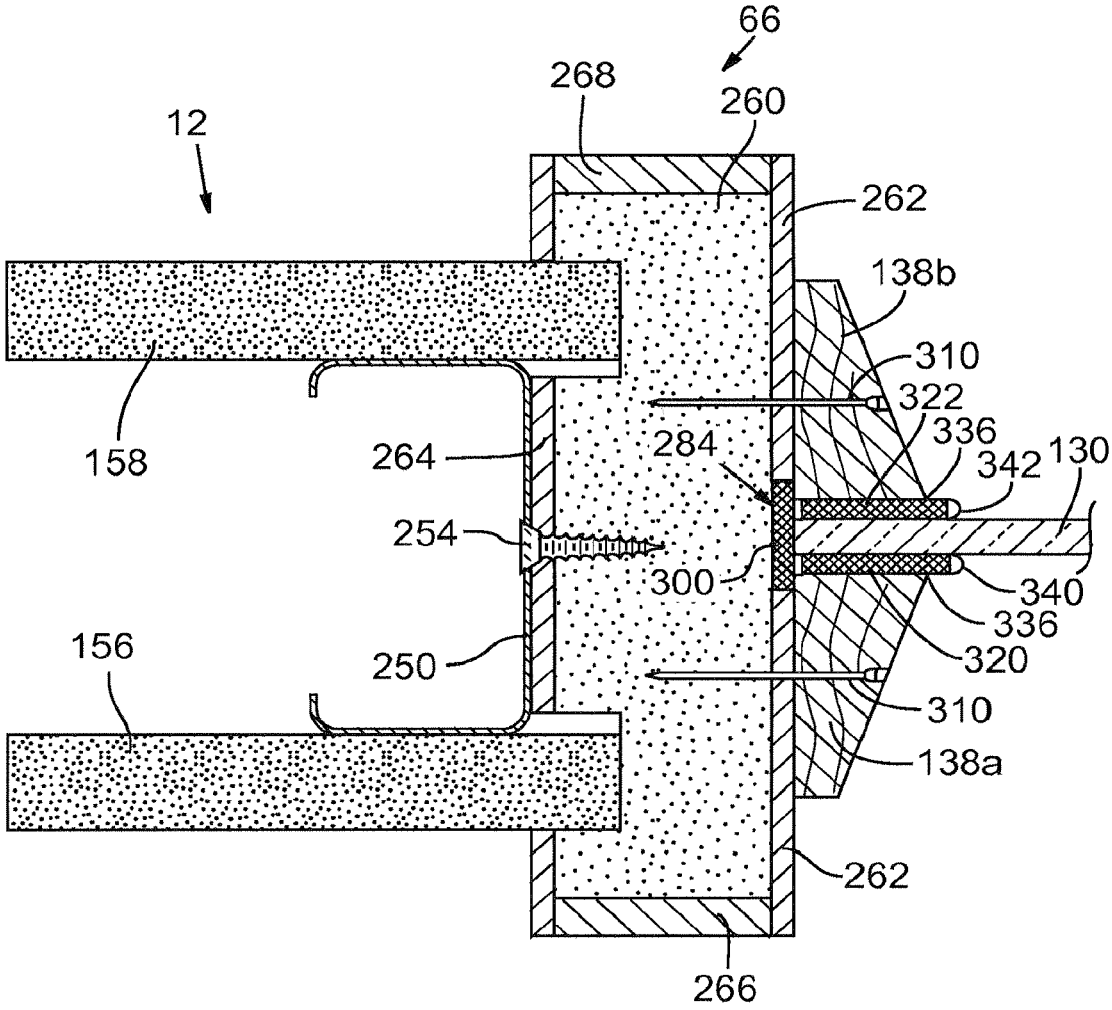
FIG. 5 is an enlarged cross section view showing detail of a sidelite jamb portion of the sidelite frame of FIG. 2.

FIG. 5 is an enlarged cross section view of sidelite jamb 66 of glazing frame 134 of FIG. 2 showing detail of wall 12. Sidelite jamb 66 is attached to a second wall stud 250 with a screw 254 and fitted to inside and outside drywall panels 156 and 158 in a manner similar to right side jamb 34 (FIG. 3 and alternative flatjamb embodiments described above). A core 260, a glass-side trim 262, a backing trim 264 and inside and outside face trim 266 and 268 are assembled in the same manner as door jamb 34, but without the laminated and concealed strip of intumescent material 200. To minimize parts and inventories required in a manufacturing operation, sidelite jamb 66 and door jamb 34 may be made to have the same general shape, size, trim thicknesses, and materials. A glazing dado 284 is cut into a glass-side 288 of sidelite jamb 66. Glazing dado 284 is formed along the length of sidelite jamb 66 and is sized to fit a strip of intumescent material 300 (hereinafter "glass end intumescent 300"), which is adhesively secured in glazing dado 284 before sidelite glass 130 is installed. Glass-end intumescent 300 is preferably an adhesive backed strip of PALUSOL-104 ranging between approximately 0.500 inch and 1.5 inch wide and between approximately 0.0625 inch (1/16") and 0.1875 inch (3/16") thick, and are preferably 0.750 inch (3/4") wide and 0.125 inch (1/8") thick. Other types of intumescent material may be used as an alternative to PALUSOL-104.

Sidelite glass 130 and any other glazing of doorway and light assembly 10 may be made of any of a variety of types of glass, including tempered glass, security glass, insulated glass, double pane glass, and others. Special temperature rise glass may be used for sidelite glass 130 and other glazing members to increase fire resistance and enhance positive-pressure test performance. A suitable temperature rise glass is made by Pilkington plc of St. Helens, United Kingdom under the name PYROSTOP™ and sold in the United States by Technical Glass Products of Kirkland, Wash.

A pair of adjacent glazing stops 138*a* and 138*b* are nailed into sidelite jamb 66 using finishing nails 310 to support sidelite glass 130 in glazing frame 134 (FIG. 2). Glazing stops 138*a* and 138*b* are preferably made of hardwood and may optionally be treated with a fire-retardant coating. However, other materials such as plastic or metal may also be suitable. Glazing stops 138*a* and 138*b* may be made with an angled face, as shown, or with a square or rectangular cross section. Inside and outside glazing stop strips of intumescent material 320 and 322 (hereinafter "inside IM strip 320" and "outside IM strip 322") are adhered to stop faces 326*a* and 326*b* of respective inside and outside glazing stops 138*a* and 138*b* and interposed between respective glazing stops 138*a* and 138*b* and sidelite glass 130. Inside and outside IM strips 320 and 322 extend adjacent to sidelite glass 130 preferably slightly beyond distal edges 336 of glazing stops 138*a* and 138*b* to reduce a shielding and insulating effect of glazing stops 138*a* and 138*b*, thereby allowing IM strips 320 and 322 to more quickly activate in the event of a fire. IM strips 320 and 322 are preferably made of PALUSOL-104 that is wrapped in plastic sleeves 340 and 342 to enhance aesthetic appearance and discourage tampering where IM strips 320 and 322 extend from glazing stops 138*a* and 138*b*.

Pre-assembly during manufacturing of glass-end intumescent 300 and inside and outside IM strips 320 and 322 to components of glazing frame 134 reduces installation errors at construction sites, ensures proper placement of intumescent material for optimal performance, and prevents breakage of intumescent strips that can otherwise occur if shipped separately from glazing frame components.

Figure 6:
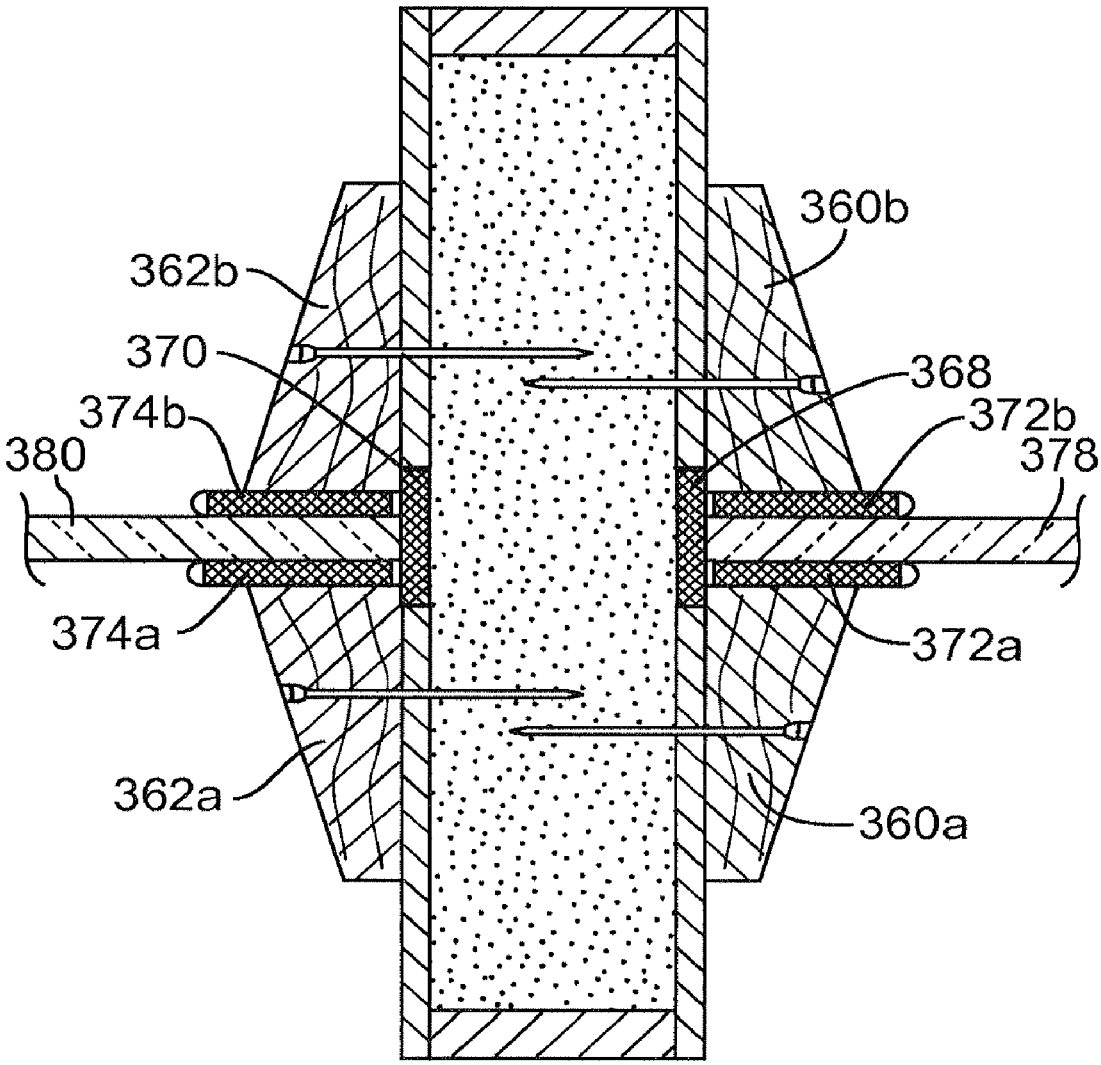
FIG. 6 is an enlarged cross section view taken along line 6-6 of FIG. 1, showing detail of a transom mullion member of a glazing frame portion of the doorway and light assembly of FIG. 1.

FIG. 6 is an enlarged cross sectional view taken along line 6-6 of FIG. 1, showing detail of a transom mullion member 76 of glazing frame 134. With reference to FIG. 6, transom mullion 76 (hereinafter "mullion") includes two sets of glazing stops 360*a*/360*b* and 362*a*/362*b*, two strips of glass end intumescent 368 and 370, and two sets of inside and outside IM strips 372*a*/372*b* and 374*a*/374*b*, for securing right and left transom glass panels 378 and 380, respectively. Other than the absence of features for attachment to a wall 12, mullion 76 is similar to sidelite jamb 66 in its arrangement and assembly at the interface with glazing 378 and 380 (as at the interface between sidelite jamb 66 and sidelite glass 130), but functions to divide two adjacent panes of glass 378 and 380 where sidelite jamb 66 does not.

Figure 7:
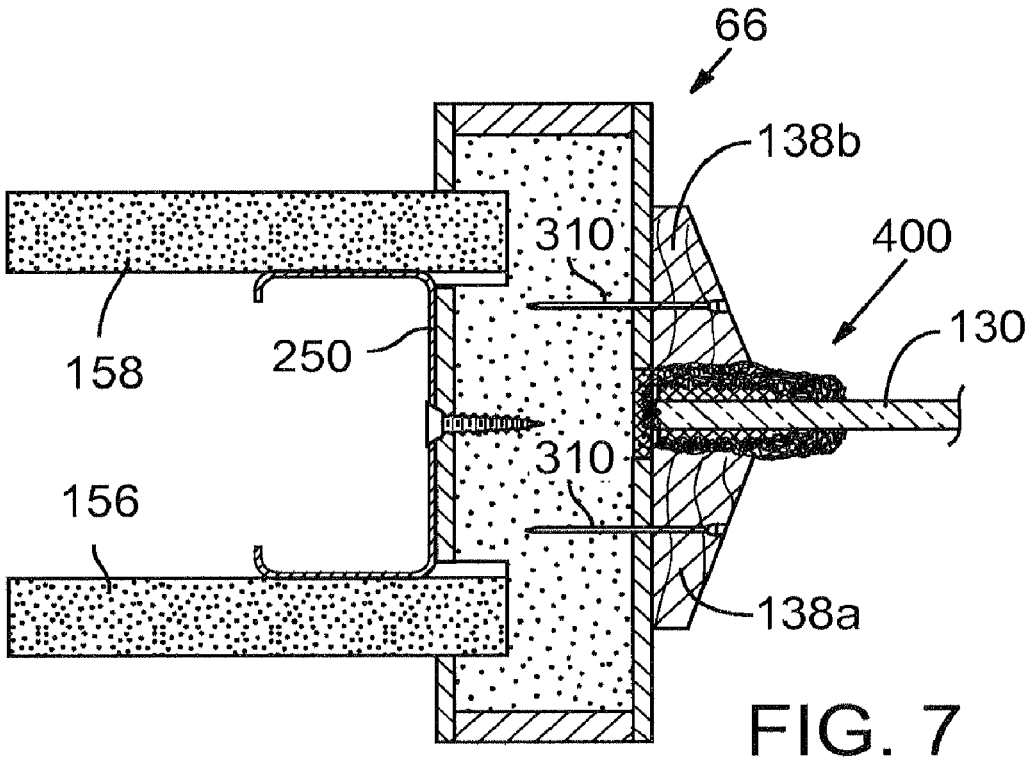
FIG. 7 is a cross section view corresponding to FIG. 5, showing how an intumescent material insert of the sidelite jamb reacts to fire.

FIG. 7 is a cross sectional view corresponding to FIG. 5 showing how glass end intumescent 300 and inside and outside IM strips 320 and 322 (FIG. 5) of sidelite jamb 66 react to fire to expand along sidelite glass 130. Due to their proximity, glass end intumescent 300 bonds with expanded IM strips 320 and 322, which then char to form a strong, unitary, fire-resistant U-shaped clip 400 that holds sidelite glass 130 in place. This clip-forming effect eliminates the need for costly metal glazing clips used in prior art glazing frames, which are time consuming and, therefore, expensive to install. Mullion 76 benefits from the same shielding and bonding effects as sidelite jamb 66 due to their similar designs.

Door frame assemblies made in accordance with the preferred embodiments described herein have been tested and certified by Underwriters Laboratories Inc. to meet 20-minute and 45-minute positive pressure test requirements under UL 10C (1st Edition) and UBC 7-2 (1997) Parts I and II. Glazing frame assemblies made in accordance with the preferred embodiments described herein have been tested and certified by Underwriters Laboratories Inc. to meet 45-minute and 60-minute positive pressure test requirements under ANSI/UL 263 (13th Edition).

Persons skilled in the art will understand that the principles of the above-described embodiments of the invention are readily applied to door frames and glazing frames of a variety of shapes, sizes, configurations, and materials. It will also be obvious to those having skill in the art that many changes may be made to the details of the above-described embodiments without departing from the underlying principles of the invention. The scope of the present invention should, therefore, be determined only by the following claims.

The invention claimed is:

1. A fire resistant frame surrounding a portion of an opening sized to accommodate a panel capable of impeding the spread of fire, the frame comprising:

an intumescent material at least partially embedded in the frame adjacent the panel;

a first trim positioned over at least a portion of the intumescent material, the first trim having a first surface facing the panel, and wherein a panel-facing outer surface of the intumescent material is positioned at a maximum depth from the first surface of the first trim, the maximum depth selected to facilitate the formation of a seal between the frame and the panel; and a face trim abutting the first trim, wherein the face trim has an outer face surface orthogonal the first surface of the first trim facing the panel, the intumescent material is at least partially embedded in the face trim, and the intumescent material is positioned a maximum distance from the outer face surface that is selected to facilitate the expansion of the intumescent material, wherein the intumescent material and the first trim are coupled to one another so that no air gap is formed between the intumescent material and the first trim.

2. The frame of claim 1, wherein the maximum distance is between approximately 1/16 inch and approximately 3/16 inch.

3. The frame of claim 1, wherein the maximum depth is between approximately 1/32 inch and approximately 1/8 inch.

4. The frame of claim 1, wherein the panel comprises a door and the frame comprises a door frame.

5. The frame of claim 1, wherein the panel comprises a glazing panel and the frame comprises a glazing frame.

6. The frame of claim 1, wherein the panel comprises a glazing panel and the frame comprises a mullion.

7. The frame of claim 1, wherein the frame meets a 20-minute positive-pressure test pursuant to UL 10C (1st Edition).

8. The frame of claim 1, wherein the frame meets a 45-minute positive-pressure test pursuant to ANSI/UL 263 (13th Edition) or UL 10C (1st Edition).

9. The frame of claim 1, wherein the frame meets a 60-minute positive-pressure test pursuant to ANSI/UL 263 (13th Edition).

10. The frame of claim 1, wherein the first trim comprises a jamb trim.

11. The frame of claim 1, wherein the first trim comprises a glazing stop.

12. The frame of claim 1, wherein the first trim is secured to the frame without a fastener.

13. The frame of claim 1, further comprising:

a stop secured to the frame adjacent the panel; and a smoke seal material secured to the frame adjacent the stop and the panel.

14. The frame of claim 1, further comprising:

a core sized to extend along at least one side of the opening, the core having a dado formed in a first surface of the core facing the opening, and wherein the intumescent material is positioned in the dado and the first trim is secured to the core over at least a portion of the intumescent material and at least a portion of the first surface of the core.

15. The frame of claim 1, wherein the intumescent material and the first trim are directly connected to one another.

16. The frame of claim 1, wherein the maximum depth is between approximately 1/32 inch and approximately 3/32 inch.

17. A fire resistant frame surrounding a portion of an opening sized to accommodate a panel capable of impeding the spread of fire, the frame comprising:

an intumescent material at least partially embedded in the frame adjacent the panel;

a first trim positioned over at least a portion of the intumescent material, the first trim having a first surface facing the panel, and wherein a panel-facing outer surface of the intumescent material is positioned at a maximum depth from the first surface of the first trim, the maximum depth selected to facilitate the formation of a seal between the frame and the panel;

a face trim abutting the first trim, the face trim having an outer face surface orthogonal the first surface of the first trim that faces the panel;

a core sized to extend along at least one side of the opening, the core comprising a fire resistant medium density fiberboard; and a dado formed in the core and the face trim, the dado extending longitudinally along the length of the frame adjacent the panel and sized to accommodate the intumescent material, wherein the intumescent material is positioned in the dado so that the intumescent material is at least partially embedded in the face trim, the intumescent material and the first trim are coupled to one another so that no air gap is formed between the intumescent material and the first trim, and the intumescent material is not encapsulated by a plastic sleeve.

18. A fire resistant frame surrounding a portion of an opening sized to accommodate a panel capable of impeding the spread of fire, the frame comprising:

a core including a dado formed in a side of the core adjacent the panel;

an intumescent material positioned in the dado;

a first trim attached to a surface of the core adjacent the panel, the first trim positioned over at least a portion of the core and the intumescent material; and a face trim abutting the first trim, wherein the face trim has an outer face surface orthogonal the first trim, the intumescent material is at least partially embedded in the face trim, and the intumescent material is positioned a maximum distance from the outer face surface that is selected to facilitate the expansion of the intumescent material, wherein the intumescent material and the first trim are coupled to one another so that no air gap is formed between the intumescent material and the first trim.

19. The frame of claim 18, wherein the core comprises a medium density fiberboard material.

20. The frame of claim 18, wherein the core comprises a fire resistant medium density fiberboard material.

21. The frame of claim 18, wherein the core comprises a medium density fiberboard material having a grain structure aligned with a long dimension of the frame.

22. The frame of claim 18, wherein the intumescent material is not encapsulated by a plastic sleeve.

23. The frame of claim 18, wherein the intumescent material and the first trim are directly connected to one another.

24. The frame of claim 18, wherein the surface of the core adjacent the panel is substantially flush with a surface of the intumescent material facing the panel.

25. The frame of claim 18, wherein the frame meets a 20-minute positive-pressure test pursuant to UL 10C (1st Edition).

26. The frame of claim 18, wherein the frame meets a 45-minute positive-pressure test pursuant to ANSI/UL 263 (13th Edition) or UL 10C (1st Edition).

27. The frame of claim 18, wherein the frame meets a 60-minute positive-pressure test pursuant to ANSI/UL 263 (13th Edition).

28. A fire resistant frame surrounding a portion of an opening sized to accommodate a panel capable of impeding the spread of fire, the frame comprising:

a core including a dado formed in a side of the core adjacent the panel;

an intumescent material positioned in the dado;

a jamb trim attached to a jamb-side surface of the core facing the panel, wherein the jamb trim is positioned over at least a portion of the core and the intumescent material and the jamb trim is in thermal contact with the intumescent material; and a face trim abutting the jamb trim, wherein the face trim has an outer face surface orthogonal the jamb trim, the intumescent material is at least partially embedded in the face trim, and the intumescent material is positioned a maximum distance from the outer face surface that is selected to facilitate the expansion of the intumescent material.

29. The frame of claim 28, wherein the face trim is attached to an inside-face surface of the core, the jamb trim and the face trim meet to form a seam, and the face trim has a thickness greater than a thickness of the jamb trim.

30. The frame of claim 28, wherein the frame meets a 20-minute positive-pressure test pursuant to UL 10C (1st Edition).

31. The frame of claim 28, wherein the frame meets a 45-minute positive-pressure test pursuant to ANSI/UL 263 (13th Edition) or UL 10C (1st Edition).

32. The frame of claim 28, wherein the frame meets a 60-minute positive-pressure test pursuant to ANSI/UL 263 (13th Edition).

33. The frame of claim 28, wherein the face trim has an inner surface opposite the outer face surface, the inner surface of the face trim is attached to an inside-face surface of the core, the jamb trim and the face trim meet to form a seam, and a thickness of the jamb trim, a thickness of the face trim, and a location of the dado relative to the outer face surface are selected so that in the event of a fire, the intumescent material is allowed to expand and form a seal between the frame and the panel.

34. The frame of claim 33, wherein:

the thickness of the jamb trim is between approximately 1/32 inch and approximately 3/32 inch;

the thickness of the face trim is between approximately 1/8 inch and approximately 1/4 inch; and the dado extends to within between approximately 1/16 inch and approximately 3/16 inch of the second surface of the face trim.

* * * * *